US009284674B2

(12) United States Patent
Park et al.

(10) Patent No.: US 9,284,674 B2
(45) Date of Patent: Mar. 15, 2016

(54) WASHING MACHINE AND WASHING METHOD

(75) Inventors: Soonan Park, Changwon-si (KR); Yongtae Kim, Changwon-si (KR); Kichul Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1089 days.

(21) Appl. No.: 12/961,230

(22) Filed: Dec. 6, 2010

(65) Prior Publication Data

US 2011/0131735 A1 Jun. 9, 2011

(30) Foreign Application Priority Data

Dec. 7, 2009 (KR) ..... 10-2009-0120596
Dec. 7, 2009 (KR) ..... 10-2009-0120597
Dec. 7, 2009 (KR) ..... 10-2009-0120598

(51) Int. Cl.

| | |
|---|---|
| ***D06F 35/00*** | (2006.01) |
| ***D06F 33/02*** | (2006.01) |
| ***A47L 15/42*** | (2006.01) |
| ***D06F 39/08*** | (2006.01) |

(52) U.S. Cl.

CPC ..... *D06F 33/02* (2013.01); *A47L 15/4212* (2013.01); *D06F 39/081* (2013.01)

(58) Field of Classification Search

CPC ... D06F 39/004; D06F 39/081; D06F 39/082; D06F 39/12; D06F 39/125; D06F 33/02; D06F 39/087; A47L 15/4212; A47L 15/421; G01M 3/16

USPC ..... 68/208; 340/605; 248/678

See application file for complete search history.

(56) References Cited

U.S. PATENT DOCUMENTS

| | | | | |
|---|---|---|---|---|
| 2,676,476 | A * | 4/1954 | Smith | 68/23.6 |
| 2,676,477 | A * | 4/1954 | Smith | 68/196 |
| 3,096,781 | A * | 7/1963 | Roidt | 137/314 |
| 3,200,388 | A * | 8/1965 | Uhlig | 340/604 |
| 3,874,403 | A * | 4/1975 | Fischer | 137/386 |
| 4,765,698 | A * | 8/1988 | Dooley | 312/248 |
| 5,515,702 | A * | 5/1996 | Park | 68/3 R |
| 5,722,560 | A * | 3/1998 | Mustee et al. | 220/630 |
| 2004/0123633 | A1 * | 7/2004 | Jo | 68/23 R |

(Continued)

FOREIGN PATENT DOCUMENTS

| | | | |
|---|---|---|---|
| DE | 2820470 | A * | 1/1979 |
| DE | 4040716 | A1 * | 6/1992 |

(Continued)

OTHER PUBLICATIONS

KR1020050066528 Machine Translation.*

(Continued)

*Primary Examiner* — Michael Kornakov
*Assistant Examiner* — Marc Lorenzi
(74) *Attorney, Agent, or Firm* — Birch, Stewart, Kolasch & Birch, LLP

(57) ABSTRACT

Provided are a washing machine and a washing method. The washing machine includes a cabinet, an outer tub disposed in the cabinet and provided with an opened top through which wash water is supplied into the outer tub, an inner tub that is disposed in the outer tub to receive laundry and rotates about a vertical axis, a base that supports the cabinet and stores the wash water that is splattered from the outer tub by rotation of the inner tub, and an electrode sensor that is disposed on the base to detect the wash water splattered out of the outer tub.

12 Claims, 20 Drawing Sheets

(56) References Cited

U.S. PATENT DOCUMENTS

| | | | | |
|---|---|---|---|---|
| 2004/0163185 | A1* | 8/2004 | Kim et al. | 8/158 |
| 2006/0081014 | A1 | 4/2006 | Choi et al. | |
| 2006/0218976 | A1* | 10/2006 | Lee et al. | 68/15 |
| 2007/0044519 | A1* | 3/2007 | Kim et al. | 68/24 |
| 2007/0101512 | A1* | 5/2007 | Lee | 8/158 |
| 2008/0068189 | A1* | 3/2008 | Murphy | 340/605 |
| 2009/0057527 | A1* | 3/2009 | Jo | 248/639 |
| 2009/0134301 | A1* | 5/2009 | Dysinger et al. | 248/346.01 |
| 2010/0126235 | A1* | 5/2010 | Bolduan et al. | 68/208 |

FOREIGN PATENT DOCUMENTS

| | | | | |
|---|---|---|---|---|
| DE | 102007056425 | A1 * | 5/2009 | |
| EP | 1329546 | A1 * | 7/2003 | |
| FR | 1591008 | A * | 4/1970 | A47L 15/421 |
| JP | 2004-305707 | A | 11/2004 | |
| KR | 10-0336392 | B1 | 5/2002 | |
| KR | 10-2003-0055973 | A | 7/2003 | |
| KR | 10-2005-0066528 | A | 12/2003 | |
| KR | 10-0423981 | B1 | 3/2004 | |
| KR | 10-0513033 | B1 | 9/2005 | |
| KR | 10-2006-0013462 | A | 2/2006 | |
| KR | 10-2006-0023757 | A | 3/2006 | |
| KR | 10-2006-0025736 | A | 3/2006 | |
| KR | 10-2009-0106061 | A | 10/2009 | |

OTHER PUBLICATIONS

DE4040716 Machine Translation, Jun. 1992.*
DE102007056425 Machine Translation, May 2009.*
DE2820470—Machine Translation, Jan. 1979.*
FR1591008—Machine Translation, Apr. 1970.*

* cited by examiner

WASHING MACHINE AND WASHING METHOD

CROSS-REFERENCE TO RELATED APPLICATION

This application claims priority from Korean Patent Application No. 10-2009-0120596, 10-2009-0120597 and 10-2009-0120598 filed Dec. 7, 2009 in the Korean Intellectual Property Office, the disclosure of which is incorporated herein by reference in its entirety.

BACKGROUND OF THE INVENTION

1. Field of the Invention

The present invention relates to a washing machine and method of controlling the same, and more particularly, to a washing machine and method of controlling the same, which can accurately detect if wash water is splattered, and reduce an amount of the wash water that is splattered.

2. Description of the Related Art

In general, a washing machine is designed to supply water into a washing tub in which laundry is loaded and washes the laundry using a water stream action generated when the washing tub rotates. At this point, as the washing tub rotates, the water in the washing tub may be splattered from the washing tub. This causes a plurality of limitations of the washing machine.

For example, when the water splattered from the washing tub contacts electric components, the washing machine may malfunction. In addition, when the water splattered from the washing tub is collected in the washing machine, bacteria harbor, casing unsanitary environment.

Accordingly, there is a need to improve accuracy of detecting if the wash water is splattered and prevent the wash water from being further splattered when the splatter of the wash water is detected.

Meanwhile, in a top loading type of washing machine where the washing tube rotates about of a vertical axis, a phenomenon in which a large amount of the wash water is splattered from the washing tube in a specific direction due to partial deformation of the washing tub caused by the rotation of the washing tub may occur. Therefore, disposition of a unit for detecting splattered water has to be carefully considered to accurately detect if the wash water is splattered.

SUMMARY OF THE INVENTION

It is an object of the present invention to provide a washing machine and a washing method, which can accurately detect if wash water is splattered, and reduce an amount of the splattered wash water.

According to an aspect of the present invention, a washing machine includes a cabinet; an outer tub disposed in the cabinet and provided with an opened top through which wash water is supplied into the outer tub; an inner tub that is disposed in the outer tub to receive laundry and rotates about a vertical axis; a base that supports the cabinet and stores the wash water that is splattered from the outer tub by rotation of the inner tub; and an electrode sensor that is disposed on the base to detect the wash water splattered out of the outer tub.

The washing machine may further include a control unit that, when the wash water splattered to the base is detected by the electrode sensor during the forming of centrifugal water circulation formed by the wash water that rises along a space defined between the outer and inner tubs by continuous rotation of the inner tub in a direction and is poured into the inner tub, reduces an RPM of the inner tub such that a rising height of the wash water rising along the space between the inner and outer tubs is lower than an upper end of the inner tub.

The base may include an electrode sensor mounting portion on which the electrode sensor is mounted and a water collection inclined surface that is formed on the electrode sensor mounting portion to direct the splattered wash water toward the electrode sensor mounting portion. Here, the water collection inclined surface may be inclined downward toward the electrode sensor mounting portion and a rib may be formed on an edge of the water collection inclined surface and extend along an inclined direction to limit flow of the wash water flowing along the water collection inclined surface in a lateral direction.

Meanwhile, the electrode sensor mounting portion may include a water collecting portion that is depressed to collect the wash water introduced along the water collection inclined surface, wherein the electrode sensor may detect the wash water collected in the water collecting portion. The electrode sensor may include first and second electrodes spaced apart from each other, wherein the first and second electrodes may be spaced apart from a bottom surface from the water collecting portion. The first and second electrodes may be disposed in parallel with the bottom surface of the water collecting portion.

Meanwhile, a rib may be formed along an edge of the electrode sensor mounting portion, wherein the rib may be spaced apart from the electrode sensor by a predetermined distance such that the wash water overflowing the water collecting portion can be drained out of the electrode sensor mounting portion.

Meanwhile, the base may include a first water storage unit that is formed along a circumference of the base to collect the splattered water flowing down along an inner surface of the cabinet. At this point, a coupling portion may protrude from a bottom surface of the first water storage unit and a coupling member for fixing the cabinet may be coupled to the coupling portion, wherein the bottom surface of the first storage unit may be further elevated from other surfaces such that the wash water splattered toward the coupling portion flows downward.

Meanwhile, the washing machine may further include a back panel coupled to a rear portion of the cabinet and provided with an air hole communicating with an inside of the cabinet, wherein the back panel may include a splattered water guide that extends from an upper portion of the air hole toward the inside of the cabinet and is inclined downward toward the inside of the cabinet to prevent the splattered water from leaking to an external side through the air hole. Here, the splattered water guide may be formed by bending a part that is partly cut from the back panel toward the inside of the cabinet to form the air hole.

Meanwhile, the electrode sensor may be disposed at a left side of a rear portion of the base and the inner tub may rotate counterclockwise when the centrifugal water circulation that is formed by the wash water that rises along a space defined between the outer and inner tubs by continuous rotation of the inner tub in a direction and is poured into the inner tub is formed.

Alternatively, the electrode sensor may be disposed at a right side of a rear portion of the base and the inner tub may rotate clockwise when the centrifugal water circulation that is formed by the wash water that rises along a space defined between the outer and inner tubs by continuous rotation of the inner tub in a direction and is poured into the inner tub is formed.

According to another aspect of the present invention, a washing method includes forming a centrifugal water circulation that is formed by wash water that rises along a space defined between an outer tub and an inner tub rotatably disposed in the outer tub by continuous rotation of the inner tub in a direction and is poured into the inner tub; and reducing, when the wash water splattered to the base is detected by the electrode sensor during the forming of centrifugal water circulation formed by the wash water that rises along a space defined between the outer and inner tubs by continuous rotation of the inner tub in a direction and is poured into the inner tub, an RPM of the inner tub such that a rising height of the wash water rising along the space between the inner and outer tubs is lower than an upper end of the inner tub.

RPM reduction of the inner tub may be performed instead of forming the centrifugal water circulation until a N-th centrifugal water circulation forming process that is set to be performed after the RPM of the inner tub is reduced by the detection of the splattered wash water by the electrode sensor such that the rising height of the wash water rising along the space between the inner and outer tubs is lower than the upper end of the inner tub.

In addition, the washing method may further include storing splattered water detection information that is detected by the electrode sensor during the forming of the centrifugal water circulation. RPM reduction of the inner tub may be performed instead of forming the centrifugal water circulation in a process that is set to perform the forming of the centrifugal water circulation according to the splattered water detection information such that the rising height of the wash water rising along the space between the inner and outer tubs is lower than the upper end of the inner tub.

BRIEF DESCRIPTION OF THE DRAWINGS

The features and advantages of the present invention will become more apparent from reading the Detailed Description of the Invention which makes reference to the attached drawings in which.

DETAILED DESCRIPTION OF THE INVENTION

Figure 1:
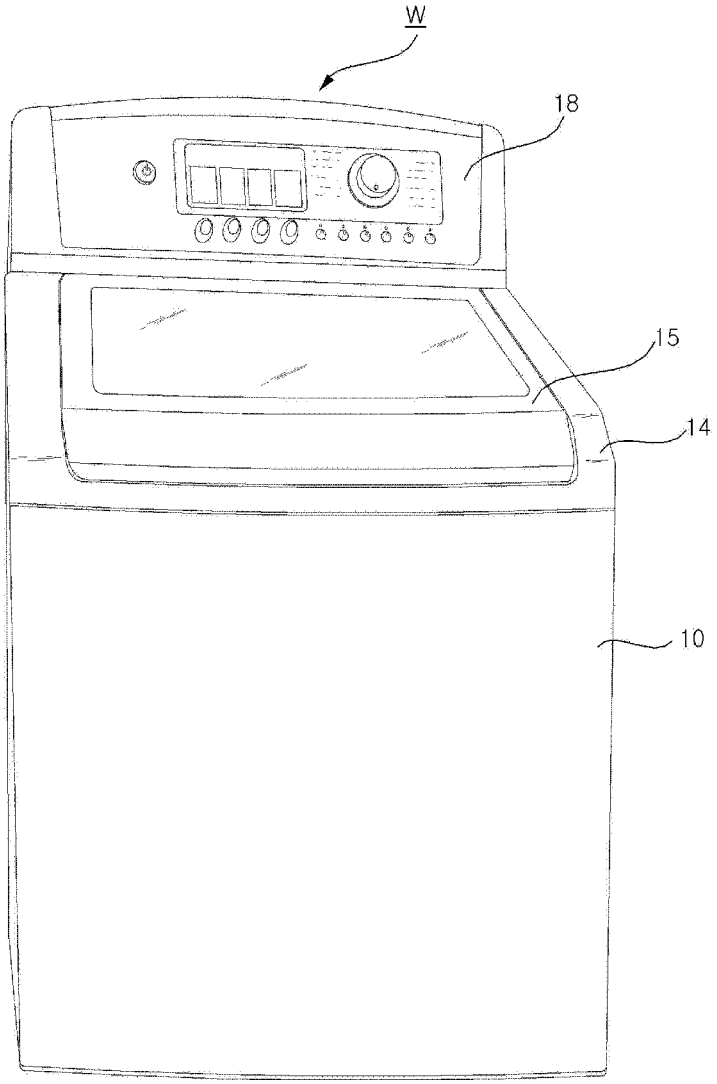
FIG. 1 is a perspective view of a washing machine according to an embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided such that this disclosure is thorough, and will fully convey the scope of the invention to those skilled in the art. Like reference numerals in the drawings denote like elements.

Figure 2:
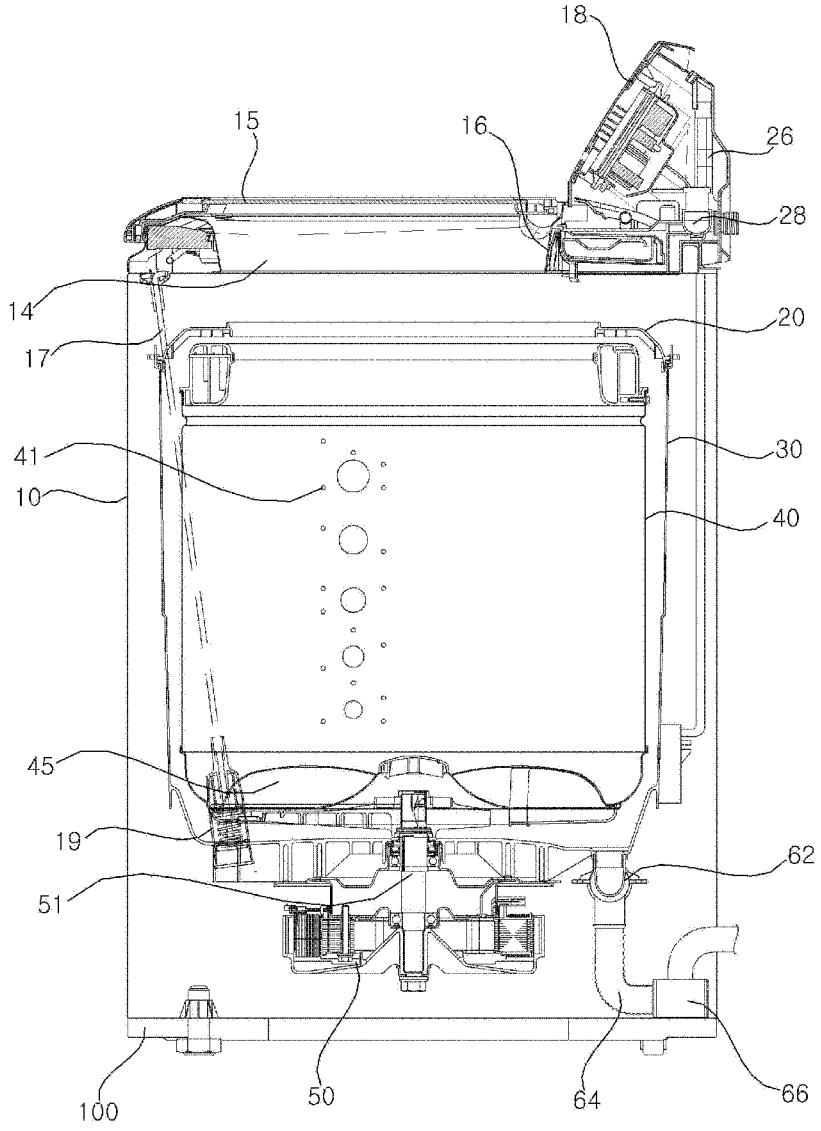
FIG. 2 is a lateral sectional view of the washing machine in FIG. 1.
Figure 3:
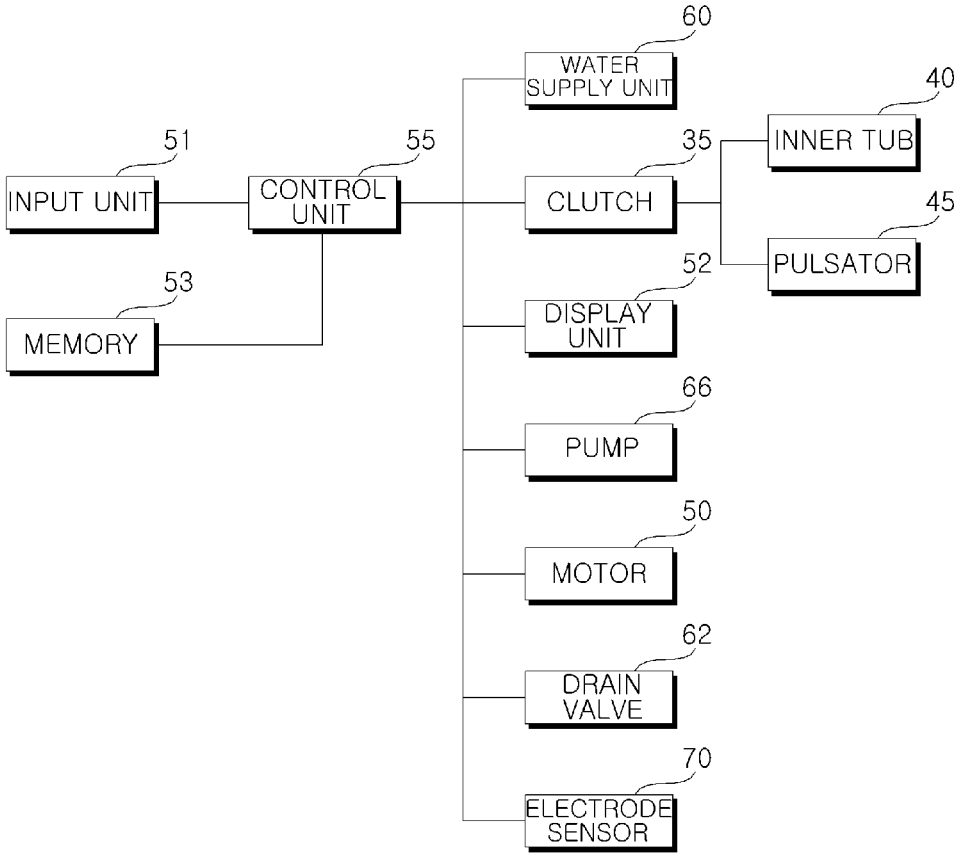
FIG. 3 is a block diagram illustrating the controlled connection between the main parts of the washing machine according to an embodiment.
Figure 4:
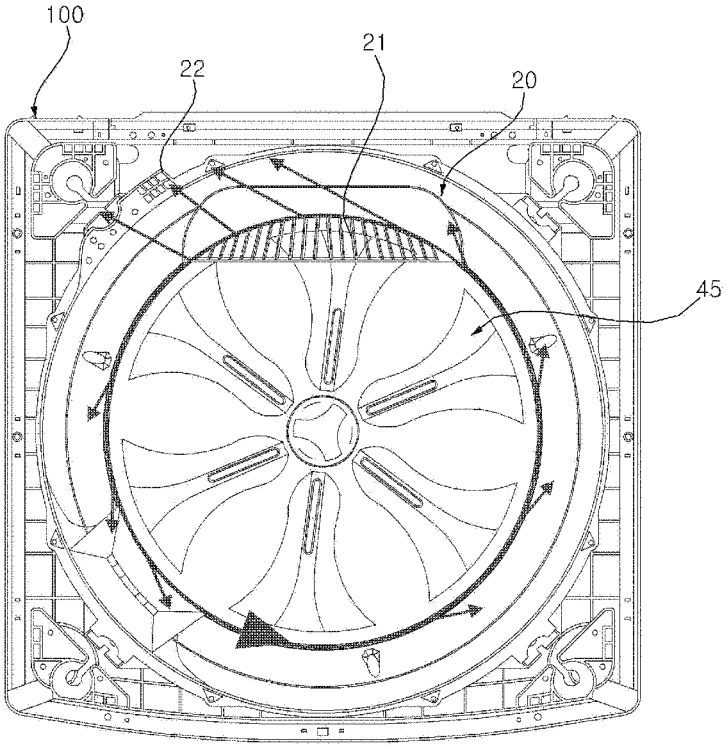
FIGS. 4 and 5 are diagrams showing the inside of a washing machine according to embodiments when viewed from above, and illustrate wash water being splattered according to the rotating direction of an inner tub.
Figure 5:
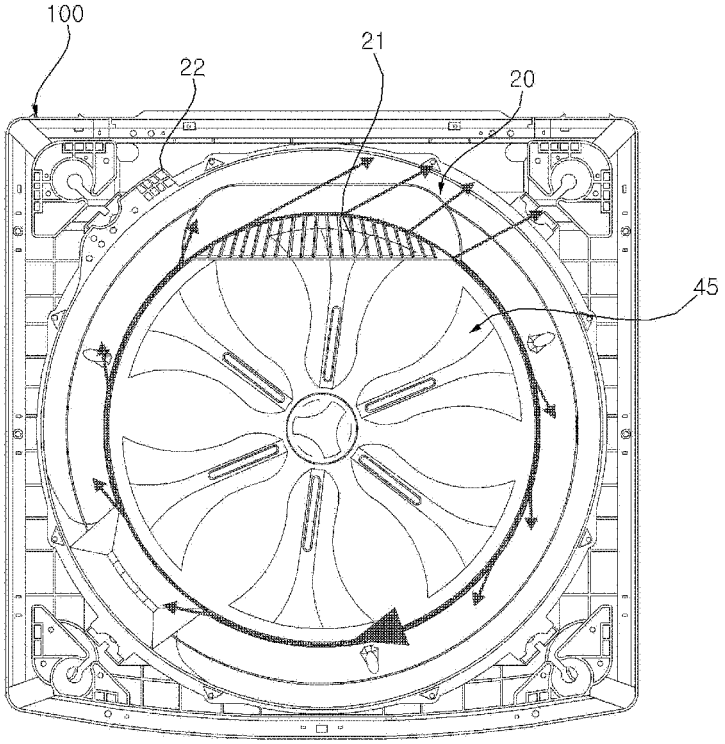

FIG. 1 is a perspective view of a washing machine W according to an embodiment of the present invention. FIG. 2 is a lateral sectional view of the washing machine W in FIG. 1. FIG. 3 is a block diagram illustrating the controlled connection between the main parts of the washing machine W according to an embodiment. FIGS. 4 and 5 are diagrams showing the inside of a washing machine W according to embodiments when viewed from above, and illustrate wash water being splattered according to the rotating direction of an inner tub 40.

Referring to FIGS. 1 to 5, a washing machine W according to an embodiment of the present invention may include a base 100 provided at the lower portion of the washing machine W and having a pump 66 and various other components installed thereon, a cabinet 10 supported by the base 100 and having an open top portion, a top cover 14 coupled to the top portion of the cabinet 10 and having a laundry loading hole formed in the central portion thereof to enable laundry to be loaded/unloaded, a door 15 pivotably provided on the top cover 14 to open and close the laundry loading hole, a control panel 18 providing a user interface and provided with an input unit 51 for receiving various control commands on the overall operation of the washing machine W from a user through an input member such as a button, etc. and a display unit 52 for displaying information on the overall operating state of the washing machine W through a display member such as an LCD, LED, and/or light emitting diode to the outside, and a water supply unit 60 for supplying wash water from an outside water source such as a faucet through a water supply passage 26. The water supply unit 60 may include a water supply valve 28 for restricting the water supply passage 26.

The cabinet 10 is provided inside with an outer tub 30 open at the top to be filled with wash water supplied from the top through the water supply passage 26, and an inner tub 40 that holds laundry and rotates about a vertical axis within the outer tub 30, and a pulsator 45 is rotatably provided on the floor of the inner tub 40. The inner tub 40 defines a plurality of water holes to enable circulation of wash water between the inner tub 40 and the outer tub 30, wash water is made to flow within the inner tub 40 and the outer tub 30 by means of the rotation of the inner tub 40 and/or the pulsator 45, and the water vortex action generated thereby and frictional action between the pulsator 45 and laundry perform the washing of the laundry.

A passage may be formed for wash water supplied through the water supply passage 26 to be routed through a detergent box 16 provided on the top cover 14, and in this case, washing additives introduced into the detergent box 16 such as laundry detergent, fabric softener, and/or bleach are dissolved and supplied to the outer tub 30 and the inner tub 40.

The outer tub 30 hangs on the top cover 14 by means of a supporting member 17, and a damper 19 is provided on an end of the supporting member 17 to dampen vibrations generated during operation of the washing machine W and securely support the outer tub 30 and the inner tub 40.

An outer tub cover 20 with its central portion open to allow loading of laundry is provided at the top of the outer tub 30, and when the inner tub 40 rotates above a certain rpm, wash water that rises along the outer tub 30 and inner tub 40 through centrifugal force is guided along the undersurface of the outer tub cover 20 to be re-supplied back into the inner tub 40 to thereby form a circulating water flow.

A motor 50 generating rotational force for rotating the inner tub 40 and/or the pulsator 45 is provided on the lower side of the outer tub 30, and the rotational force generated by the motor 50 is transferred to the inner tub 40 and/or pulsator 45 through a rotating shaft 51. A washing machine W according to an embodiment of the present invention has the inner tub 40 and pulsator 45 directly connected to the rotating shaft 51 in a direct drive type operation in which rotational force generated by the motor 50 is directly received, or alternatively, may operate in an indirect drive type configuration in which a power transmitting member such as a belt or chain transfers the rotational force from the motor 50 to the inner tub 40 and/or pulsator 45.

A clutch 35 is provided to selectively transfer the rotational force generated by the motor 50 to the inner tub 40 and the pulsator 45. Through appropriate control of the clutch 35, only the inner tub 40 may be rotated, only the pulsator 45 may be rotated, or the inner tub 40 and the pulsator 45 may be rotated in concert.

During operation of the washing machine W, the effects of a water vortices generated by means of the rotation of the inner tub 40 and/or pulsator 45 may generate splattering of wash water to the outside of the outer tub 30, in which case, the direction in which wash water is splattered is different according to the rotating direction of the inner tub 40 and/or the pulsator 45. FIG. 4 illustrates the direction of wash water splatter when the inner tub 40 rotates counterclockwise, where splattering of wash water occurs in tangential directions to a circle formed by the rotating trajectory of the inner tub 40. In particular, when considering wash water that is splattered rearward within the cabinet 10, a relatively large amount of wash water is splattered to the left rearward side of the cabinet 10, as illustrated in FIG. 4. Conversely, when the inner tub 40 rotates clockwise as illustrated in FIG. 5, the amount of wash water splattered to the right rearward side inside the cabinet 10 is large.

As above, there are many reasons why wash water is not splattered evenly within the cabinet 10 and the amount of wash water splattered in a certain direction is greater, and one of them is the effect that a laundry disengagement preventing unit 21 formed on the outer tub cover 20 has.

The laundry disengagement preventing unit 21 is formed as a structure that projects from the rear of the cover 20 toward the open central portion, to prevent laundry inside the inner tub 40 from being disengaged to the outside during rotation of the inner tub 40 and/or the pulsator 45. That is, laundry is shifted in position within the inner tub 40 according to the rotating direction of the inner tub 40 and/or pulsator 45, and there is the risk of laundry being disengaged from the inner tub 40 by means of centrifugal force generated from the rotation of the inner tub 40 and/or pulsator 45 and water vortices. In particular, with pieces of large-sized laundry such as pillows and blankets, a portion of the laundry can disengage upward. Laundry with a tendency to disengage from within the inner tub 40 collides with the laundry disengagement preventing unit 21 and is returned back into the inner tub 40.

The direction in which wash water is splattered within the cabinet changes according to the direction in which laundry collides against the laundry disengagement preventing unit 21, and the directions of wash water splattered according to the rotating direction of the inner tub 40 can easily be discerned from FIGS. 4 and 5.

When the water supply unit 60 supplies water, wash water can be splattered against the outer tub cover 20, in which case a splattered water drain hole 22 is provided in the outer tub cover 20 to drain the splattered wash water to the base 100. Of course, not only can wash water that is splattered against the outer tub cover 20 during supplying of water by the water supply unit 60 be collected, but wash water splattered from the outer tub 30 and/or inner tub 40 and wash water splattered from laundry that collides against the laundry disengagement preventing unit 21 can also be collected, and in any of these cases, the wash water that is splattered against the outer tub cover 20 is drained downward through the splattered water drain hole 22 and collected at the base 100.

A guide for guiding splattered wash water to the splattered water drain hole 22 may be formed on the outer tub cover 20, and the guide is formed as a projecting structure such as a rib or as a recessed structure such as a groove to form a passage for guiding wash water toward the splattered water drain hole 22.

A washing machine W according to an embodiment of the present invention includes an electrode sensor 70 (refer to FIGS. 6 and 7) for sensing when wash water accumulates at the base 100 due to various circumstances during operation of the washing machine W. The electrode sensor 70 senses whether a certain amount of wash water has accumulated on the base 100, on the basis of electrical properties detected when two electrodes are conducted to each other through wash water.

The electrode sensor 70 is provided at the rear of the base 100, and may be provided at the left or the right according to the rotating direction of the inner tub 40. For example, as illustrated in FIG. 4, when the direction of rotation for the inner tub 40 is counterclockwise, because there is a large amount of wash water that is splattered to the left at the rear of the base 100, the electrode sensor 70 may be provided on the left at the rear of the base 100, and as illustrated in FIG. 5, when the direction of rotation of the inner tub 40 is clockwise, the electrode sensor 70 may be provided on the right at the rear of the base 100.

The correlation between the position of the splattered water drain hole 22 and the position of the electrode sensor 70 must be considered in order to accurately sense the splattered water. When the splattered water drain hole 22 is provided on the left at the rear of the outer tub cover 20, the electrode sensor 70 may be disposed on the left at the rear of the base 100 to be below the splattered water drain hole 22, and conversely, when the splattered water drain hole 22 is provided on the right at the rear of the outer tub cover 20, the electrode sensor 70 may be disposed on the right at the rear of the base 100.

Figure 6:
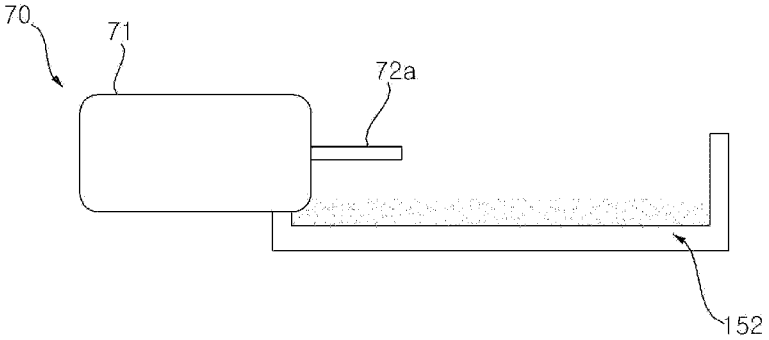
FIG. 6 illustrates an embodiment showing the configured relationship between an electrode sensor and a water collecting unit applied to a washing machine according to an embodiment.
Figure 7:
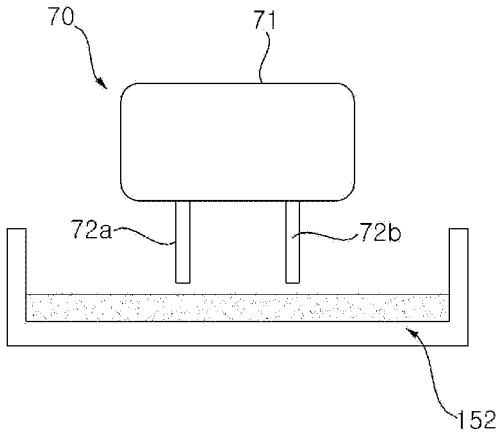
FIG. 7 is another embodiment illustrating the configured relationship between the electrode sensor and water collecting unit in FIG. 6.

FIG. 6 illustrates an embodiment showing the configured relationship between an electrode sensor 70 and a water collecting unit 152 applied to a washing machine W according to an embodiment, and FIG. 7 is another embodiment illustrating the configured relationship between the electrode sensor 70 and water collecting unit 152 in FIG. 6.

Referring to FIGS. 6 and 7, an electrode sensor 70 includes an electrode sensor main body 71, and a first electrode 72*a* and a second electrode 72*b* extending from the electrode sensor main body 71. The electrode sensor main body 71 holds various electronic components that are capable of processing an electrical signal generated when both electrodes 72*a* and 72*b* are electrically conducted with each other.

The base 100 has a water collecting unit 152 formed thereon for collecting splattered wash water, and both electrodes 72*a* and 72*b* of the electrode sensor 70 are disposed separated a certain distance from the floor of the water collecting unit 152. Accordingly, when wash water above a certain water level collects in the water collecting unit 152, each electrode 72*a* and 72*b* is contacted with the wash water such that they become electrically conductive with each other. In order to separate the floor of the water collecting unit 152 with both electrodes 72*a* and 72*b*, the following two embodiments are provided.

In the first embodiment illustrated in FIG. 6, both electrodes 72*a* and 72*b* are separated a certain distance from the floor of the water collecting unit 152 and disposed horizontally, and in the second embodiment illustrated in FIG. 7, both electrodes 72*a* and 72*b* are vertically disposed such that the ends of each electrode 72*a* and 72*b* are maintained a certain distance from the floor of the water collecting unit 152.

If both electrodes 72*a* and 72*b* of the electrode sensor 70 were to be disposed so they contacted the floor of the water collecting unit 152 (in a structure in which both electrodes 72*a* and 72*b* project from the floor of the water collecting unit 152, for example), then as wash water collected in the water collecting unit 152 dries, detergent that was dissolved in the wash water would solidify and remain in the water collecting unit 152, and such residual detergent would cover the electrodes 72*a* and 72*b* and cause malfunctioning of the electrode sensor 70.

In particular, in a state where the residual detergent is not completely dry and retains a considerable amount of moisture, even if no further splattered water should enter the water collecting unit 152, both electrodes 72*a* and 72*b* would remain electrically conducted to one another.

Also, moisture collected in the water collecting unit 152 may freeze in cold temperature environments such as during winter, and freezing of splattered water occurs quickly especially when the amount of splattered water that is collected in the water collecting unit 152 is small. Therefore, even if no further splattered water enters the water collecting unit 152 thereafter, both electrodes 72*a* and 72*b* would remain electrically conducted to one another.

Referring to the embodiments of the present invention in FIG. 6 or 7, because both electrodes 72*a* and 72*b* of the electrode sensor 70 are disposed to retain a certain distance from the floor of the water collecting unit 152, occurrence of the above problems can be prevented.

Figure 8:
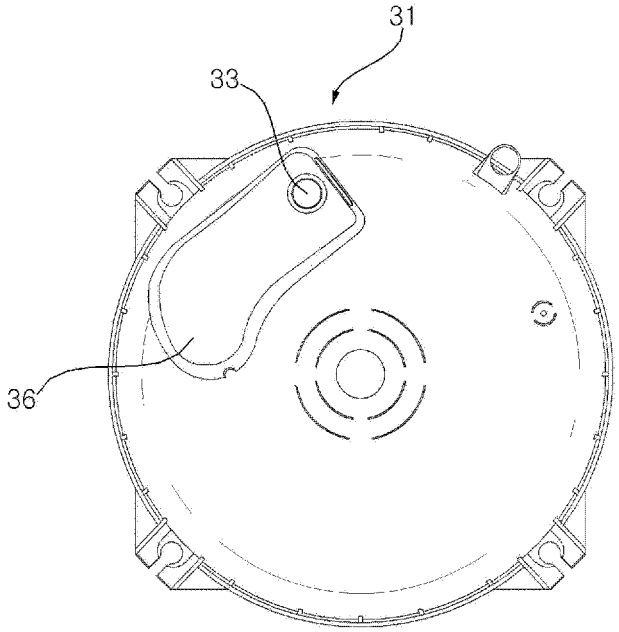
FIG. 8 is a plan view illustrating a floor of an outer tub illustrated in FIG. 2.
Figure 9:
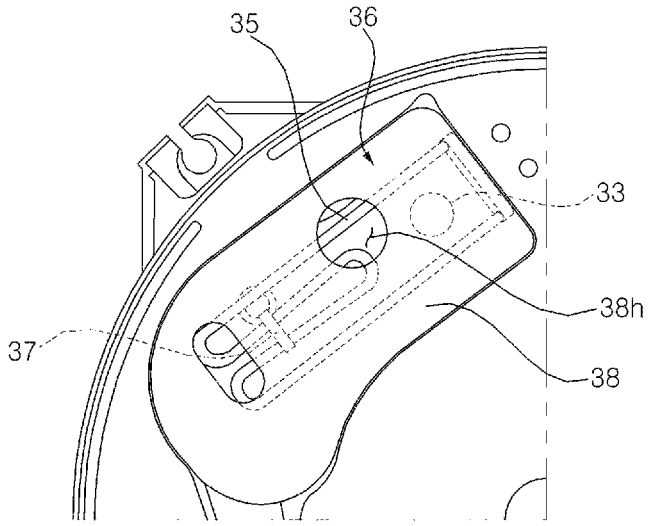
FIG. 9 is an enlargement of a portion of FIG. 8.

FIG. 8 is a plan view illustrating a floor 31 of an outer tub 30 illustrated in FIG. 2. FIG. 9 is an enlargement of a portion of FIG. 8.

Referring to FIGS. 8 and 9, a heater receiving portion for receiving a heater 35 may be formed on a rear-left side of the bottom surface 31 of the outer tub. The heater receiving portion 36 may be formed by depressing the bottom surface 31 of the outer tub to define a space for receiving the heater 35. A bracket 37 fixes the heater 35 in the heater receiving portion 36. A heater cover 38 for covering the heat receiving portion 36 may be provided. The heater cover 38 is provided with a hole 38*h* through which the wash water in the outer tub 30 can be introduced into the heater receiving portion 36. A drain hole 33 is formed through a bottom of the heater receiving portion 36 to drain the wash water. The wash water drained through the drain hole 33 is drained out of the washing machine W through a drain passage 64 and a pump 66.

As described above, due to a structural characteristic where the heater receiving portion 36 on the bottom surface 31 of the outer tub 30, a splatter direction of the wash water may be affected when the inner tub 40 rotates.

Since the heater receiving portion 36 is formed by depressing the bottom surface of the outer tub, strength of the portion where the heater receiving portion 36 is formed is different from other portions of the bottom surface 31. Accordingly, the strength of the rear portion of the outer tub 30 is relatively weak due to the heat receiving portion 36. Therefore, the rear portion of the outer tub 30 is largely deformed and a distance between the rear portion of the outer tub 30 and the inner tub 40 varies.

For example, when the outer tub 30 is formed of a material such as plastic, which is easily deformed by external force, the rear force of the outer tub, which is weak in the strength, is widened outward by centrifugal force applied by the wash water when the inner tub 40 rotates. Accordingly, the distance between the rear portion of the outer tub 30 and the inner tub 40 increases and the distance between the front portion of the outer tub 30 and the inner tub 40 is relatively reduced. This deformation of the outer tub 30 causes more wash water to be splattered toward the rear portion of the outer tub 30 when the inner tub 30 rotates. Rising force of the wash water rising through a narrow space between the front portion of the outer tub 30 and the inner tub 40 will be greater than rising force of the wash water rising through a wide space between the rear portion of the outer tub 30 and the inner tub 40. Particularly, when the wash water rises higher than an upper end of the inner tub 40 along the narrow space between the front portion of the outer tub 30 and the inner tub 40 by the sufficient RPM of the inner tub 40, an amount of the wash water that is guided along the bottom surface of the outer cover 20 to be splattered rearward increases.

In this embodiment, the heater receiving portion 36 formed on the rear-left portion of the bottom portion 31 of the outer tub. When the inner tub 40 rotates, an amount of the wash water that rises along the narrow space between the front-right portion of the outer tub 30 and the inner tub 40 and is splattered toward a rear-left side of the base 100 is larger than that that of other portions.

Meanwhile, when both of a washing machine model that is equipped with the heater and a washing machine model that is not equipped with the heater are released to a market, in order to reduce a design/manufacturing costs and provide compatibility of the components, the outer tub 30 provided with the heat receiving portion 36 may be applied to both of the models.

In this embodiment, a structure where the splattered water drain hole 22 is formed on the rear-left portion of the outer cover 20, the heater receiving portion 36 is formed on the rear-left portion of the bottom surface 31, the inner tub 40 rotates counterclockwise when a centrifugal circulation water stream (which will be described later with reference to FIG. 19) is formed, and the electrode sensor 70 is formed on the rear-left portion of the base 100 is proposed. However, the present invention is not limited to this structure. For example, a structure where the splattered water drain hole 22 is formed on the rear-right portion of the outer cover 20, the heater receiving portion 36 is formed on the rear-right portion of the bottom surface 31, the inner tub 40 rotates clockwise when the centrifugal circulation water stream, and the electrode sensor 70 is formed on the rear-right portion of the base may be possible.

Figure 10:
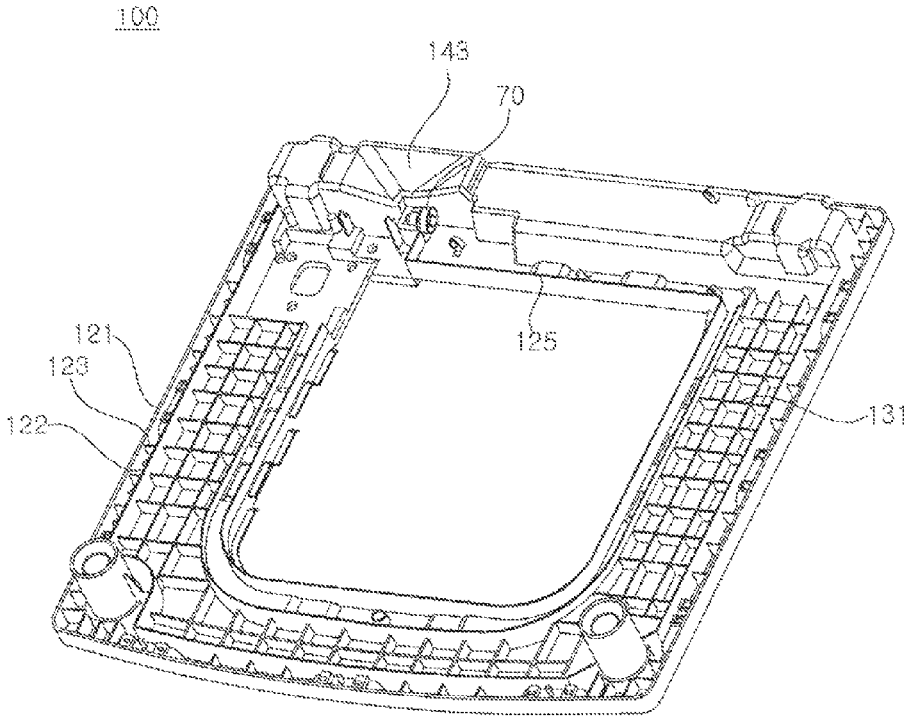
FIG. 10 is a perspective view of a base illustrated in FIG. 1.
Figure 11:
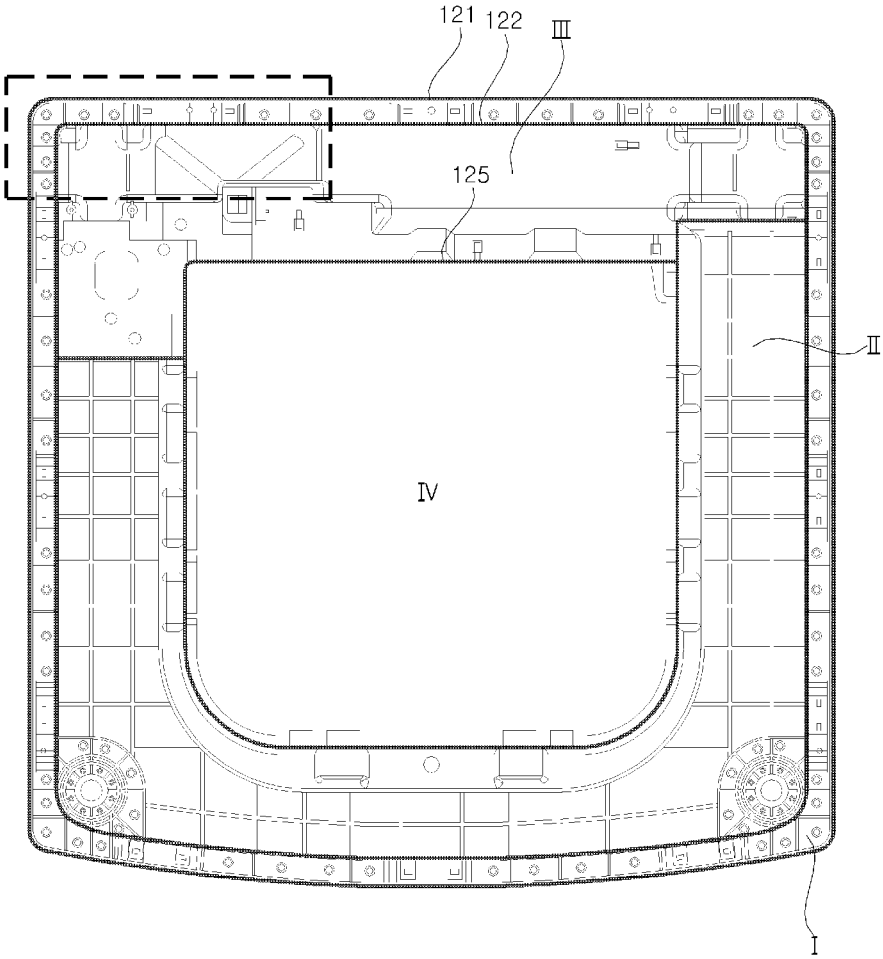
FIG. 11 is a plan view of a base illustrated in FIG. 10.
Figure 12A:
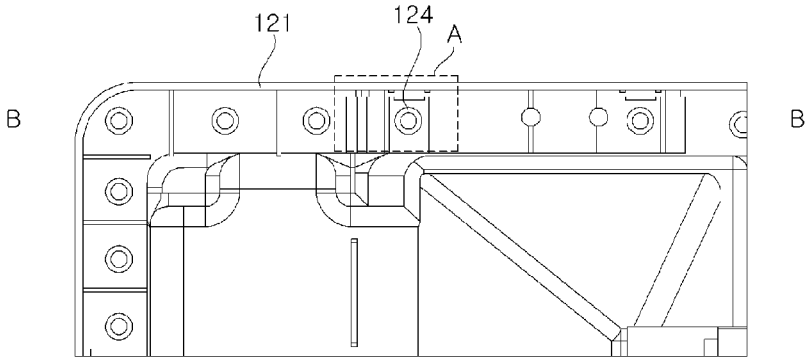
FIG. 12A is an enlarged view of the region illustrated with a dotted line in FIG. 11.
Figure 12B:
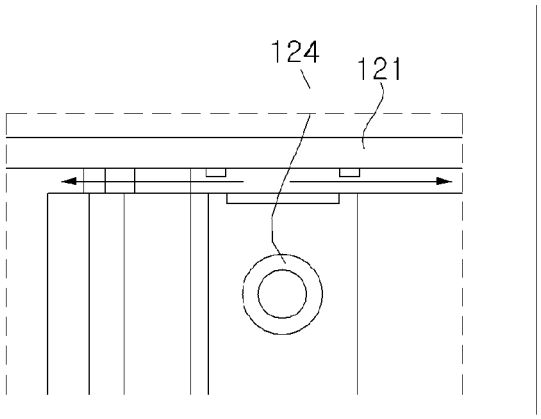
FIG. 12B is an enlarged view of region A in FIG. 12A.

FIG. 10 is a perspective view of the base depicted in FIG. 1, FIG. 11 is a top plan view of the base of FIG. 10, FIG. 12A is an enlarged view of a portion indicated by dotted-line of FIG. 11, FIG. 12B is an enlarged view of a portion A of FIG. 12A, and a cross-sectional view taken along line B-B of FIG. 12A.

The base 100 includes a first water storage unit I that extends along a circumference of the base 100 to store the splattered water, a second water storage unit II that is formed on an inner region surrounded by the first water storage unit I to store the wash water splattered toward a front portion, left portion, and right portion of the base 100, and a third water storage unit III that is formed on the inner region surrounded by the first water storage unit I to store the wash water splattered toward a rear portion of the base 100.

The first water storing portion I stores the wash water that is splattered during the operation of the washing machine W and flows down along an inner wall of the cabinet 10. The first water storage unit I is provided with a passage to store the wash water. The passage may be formed by ribs 121 and 122 that define both sides of the first water storage unit I and extend along the circumference of the base 100. A barrier 123 may be formed between the first and second ribs 121 and 122.

The second water storage unit II extends leftward and rightward at a front portion of the inner region of the base 100 surrounded by the first water storage unit I to store the wash water flowing down along the outer tub 30 or the wash water that is splattered to a front-inner portion of the cabinet. A reinforcing rib 131 formed in a lattice shape may be formed on the second water storage unit II to reinforce the strength of the base 100. The splattered wash water is stored in spaces divided by the lattice shape reinforcing rib 131.

The third water storage unit III is formed on the rear portion of the inner region of the base 100 surrounded by the first water storage unit I, i.e., on a region except for the second water storage unit II to store the wash water that flows down along the outer tub 30 or the wash water that is splattered to an inside of the rear surface of the cabinet.

Particularly, in the washing machine W according to an embodiment of the present invention, an amount of the wash water that is collected at a rear-left portion of the base 100 is greater due to the above-described many reasons. Accordingly, the electrode sensor 70 may be installed at the left portion of the third water storage unit III.

The third water storage unit III stores the wash water in a space defined by the rib 122 of the first water storage unit I and a rib 125 formed along a circumference of a central opening of the base 100.

Figure 12C:
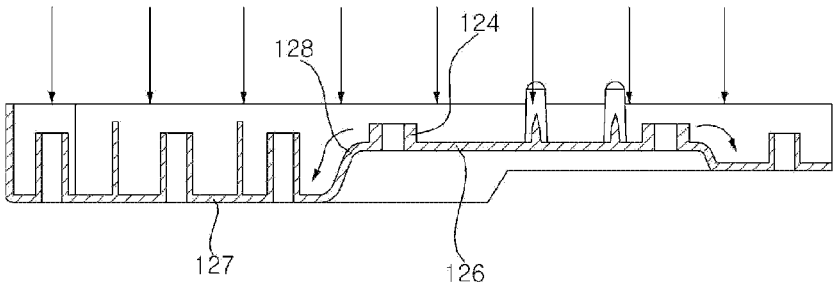
FIG. 12C is a sectional view taken along line B-B in FIG. 12A.

Referring to FIGS. 12A, 12B, and 12C, a coupling portion 124 to which a fastener such as a bolt is coupled to couple the base 100 to the cabinet 10 is formed on the first water storage unit I and the coupling portion 124 is provided in the form of a boss protruding from the bottom surface of the first water storage unit I.

When the fastener such as the bolt coupled to the coupling portion 124 contacts the wash water stored in the first storing unit I, the fastener may corrode. In order to prevent this, a passage is formed between the coupling portion 124 and the rib 121. Meanwhile, a surface 126 on which the coupling portion 124 is formed is elevated from other surfaces 127 of the first water storage unit I. Accordingly, an inclined surface 128 that extends from the surface 126 to other surfaces 127 is formed. The wash water splattered to the surface 126 on which the coupling portion 124 is formed flows along the inclined surface 128, and therefore the corrosion of the coupling member by the wash water can be reliably prevented.

Figure 13:
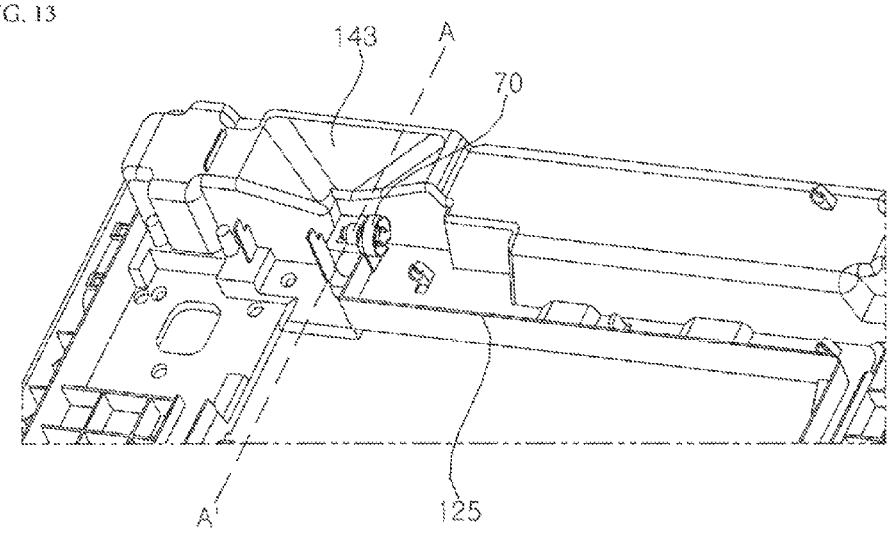
FIG. 13 illustrates a portion of a base illustrated in FIG. 10 and illustrates the configuration of a third water storage unit in detail.
Figure 14A:
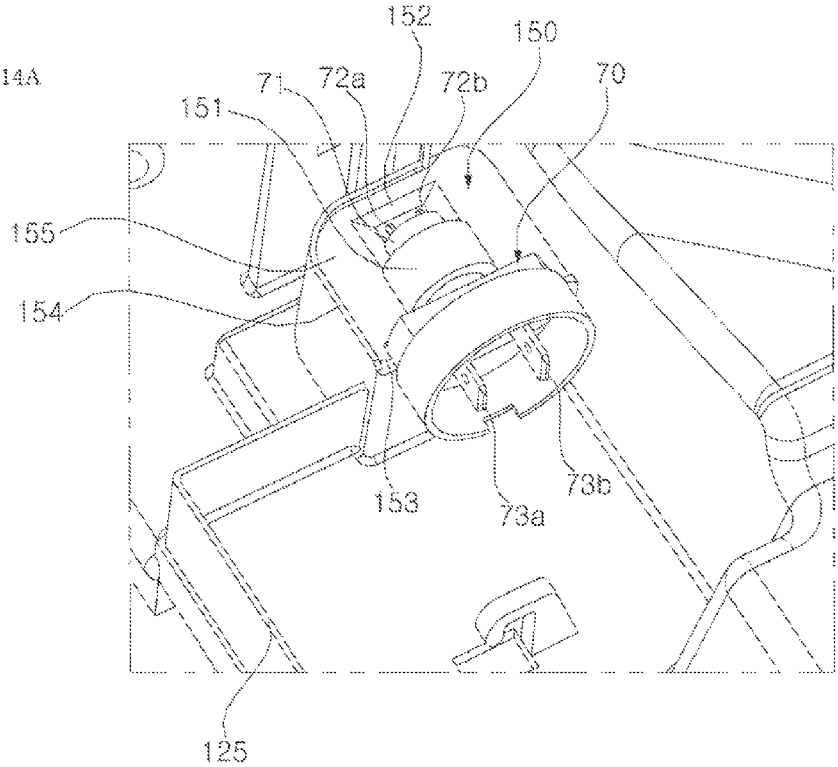
FIG. 14A is an enlarged view of a portion of FIG. 13, illustrating an electrode sensor coupled to a mounting portion for the electrode sensor.
Figure 14B:
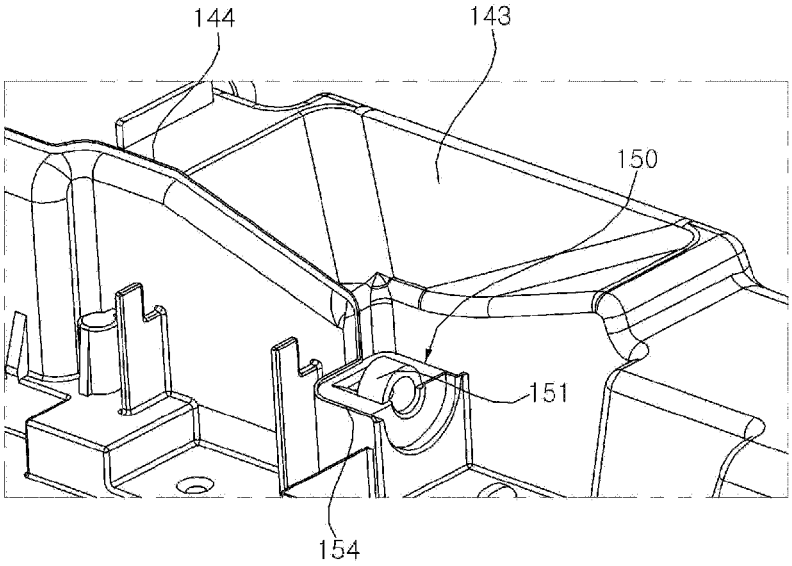
FIG. 14B is a perspective view illustrating the configuration of an electrode sensor mounting portion in FIG. 14A in more detail.
Figure 14C:
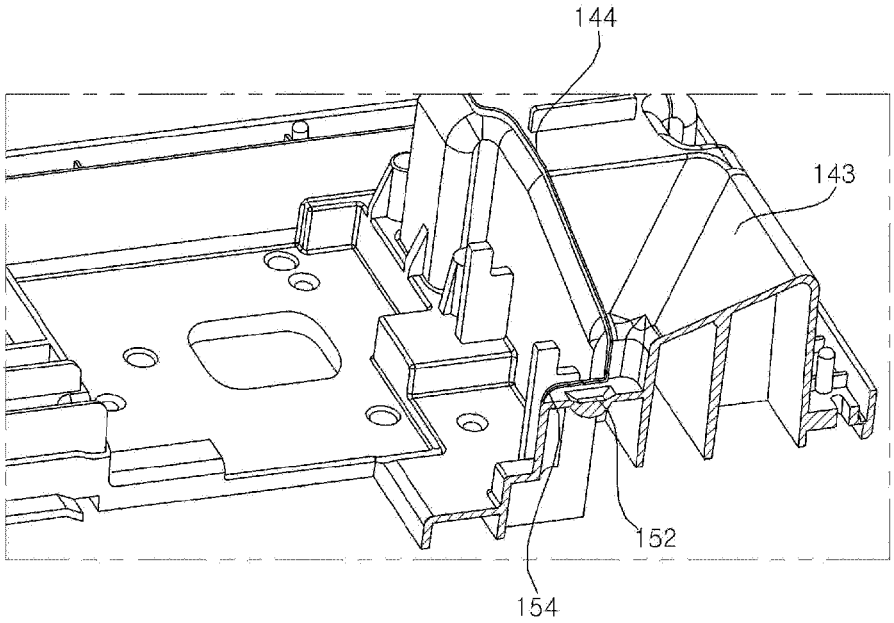
FIG. 14C is a partial perspective view illustrating the configuration of a section taken along line A-A in FIG. 13.

FIG. 13 illustrates a portion of a base illustrated in FIG. 10 to illustrate a detailed structure of the third water storage unit. FIG. 14A is an enlarged view of a portion of FIG. 13, illustrating a coupling structure of the electrode sensor 70 to an electrode sensor mounting portion 150. FIG. 14B is a perspective view illustrating a detailed structure of the electrode sensor mounting portion 150 in FIG. 14A. FIG. 14C is a partial perspective view illustrating a detailed sectional structure taken along line A-A of FIG. 13. Hereinafter, a mounting structure of the electrode sensor 70 on the base will be described in more detail with reference to FIGS. 13 and 14A to 14C.

A water collection inclining portion 143 for guiding the collection of the wash water splattered from the outer tub 30 toward the electrode sensor mounting portion 150. The water collection inclining portion 143 is inclined downward toward the electrode sensor mounting portion 150.

The electrode sensor mounting portion 150 includes a bracket 151 fixing the electrode sensor 70 and a water collecting portion 152 that is a groove in which the wash water guided along the water collection inclined surface 143 is collected. The water collecting portion 152 is formed by depressing the bottom 155 of the electrode sensor mounting portion 150 which primarily contacts the washing water flowing down along the water collecting inclining portion 143. A rib 154 is formed along an edge of the bottom 155.

When an amount of the wash water collected in the water collecting portion 152 increases and exceeds a receptive volume of the water collecting portion 152, the excess amount of the wash water is discharged through a discharge portion 153. The discharge portion 153 is defined by a gap between the electrode sensor 70 and the rib 154.

Both electrodes 72*a* and 72*b* of the electrode sensor 70 are horizontally arranged in parallel with each other and spaced apart from the bottom of the water collecting portion 152. The control unit 55 determines if the wash water is splattered in accordance with an electric signal detected when the electrodes 72*a* and 72*b* are electrically connected by the wash water that is collected in the water collecting portion 152 and has a water level greater than a predetermined level such that the electrodes 72*a* and 72*b* are dipped under the wash water.

First and second terminals 73*a* and 73*b* are electrically connected to the control unit 55 to output the electric signal detected when the first and second electrodes 72*a* and 72*b* are electrically interconnected to the control unit 55. The control unit 55 controls an RPM of the inner tub 40 such that the RPM of the inner tub 40 is reduced in accordance with the electric signal transmitted from the electrode sensor 70, thereby preventing the wash water from being splattered.

Meanwhile, although the electrodes 72*a* and 72*b* of the electrode sensor 70 of FIGS. 13 and 14A are arranged at a same horizontal level, the present invention is not limited to this. For example, as shown in FIG. 7, the electrodes 72*a* and 72*b* of the electrode sensor 70 are vertically arranged and respective ends of the electrodes 72*a* and 72*b* are spaced apart from the bottom of the water collecting unit 152 by a predetermined distance. This arrangement of the electrode sensor 70 may be possible by properly varying a structure of the bracket 151.

Figure 15:
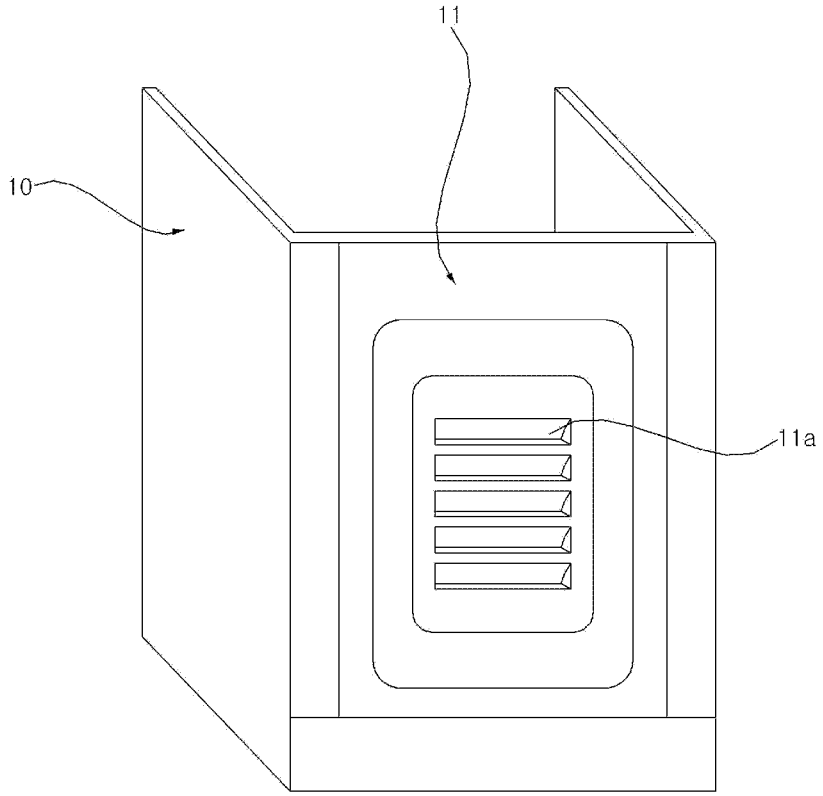
FIG. 15 is a perspective view of a cabinet illustrated in FIG. 1 as seen from behind, and illustrates the coupled state of the cabinet to a back panel.
Figure 16:
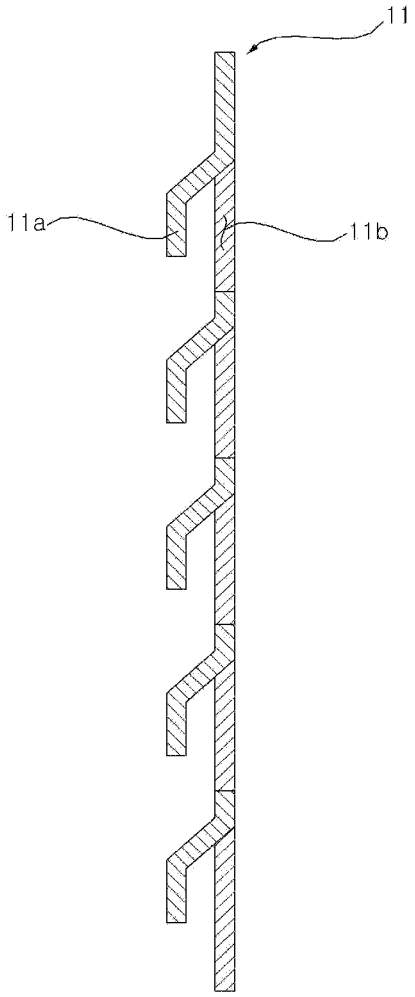
FIG. 16 is a sectional view of a back panel illustrated in FIG. 15.

FIG. 15 is a perspective view of the cabinet of FIG. 1 when it is seen from behind, illustrating a coupling state of the cabinet 10 to a back panel 11. FIG. 16 is a cross-sectional view of the back panel depicted in FIG. 15.

Referring to FIGS. 15 and 16, a back panel 11 is coupled to a rear portion of the cabinet 10. The back panel 11 is provided with an air hole 11*b* communicating with an inside of the cabinet 10. The back panel 11 is further provided with a plurality of splattered water guides 11*a* that guide the wash water splattered toward the inside of the cabinet to prevent the splattered wash water from leaking through the air hole 11*b*.

The splattered water guides 11*a* are formed by bending a surface, which is partly cut from the back panel 11 to form the air hole 11*b*, toward the inside of the cabinet 10. The splattered water guides 11*a* extends from an upper side of the air hole 11*b* toward the inside of the cabinet is inclined downward toward the inside of the cabinet 10.

The leakage of the wash water splattered toward a rear portion of the inside of the cabinet 10 through the air hole 11*b* can be prevented by interference with the splattered water guides 11*a*.

Figure 17:
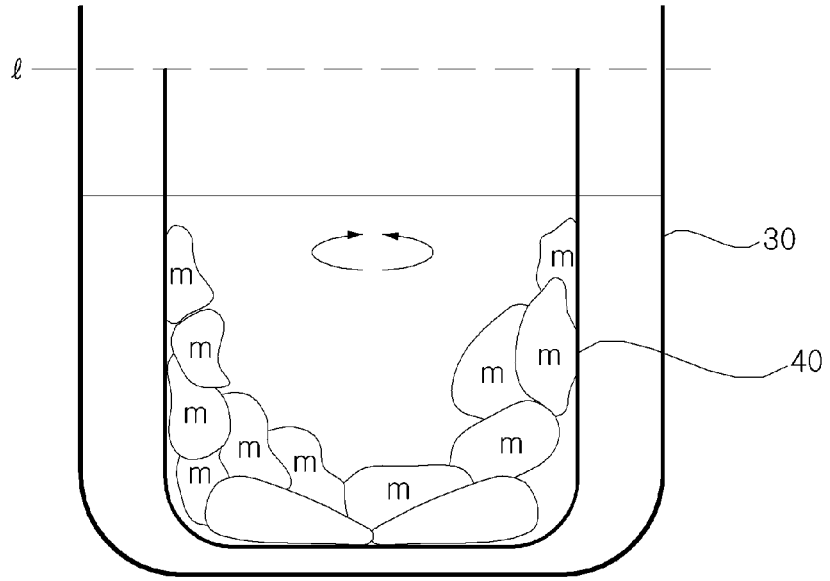
FIG. 17 illustrates the form of agitated water flow formed in the operation of a washing machine according to an embodiment of the present invention.
Figure 18:
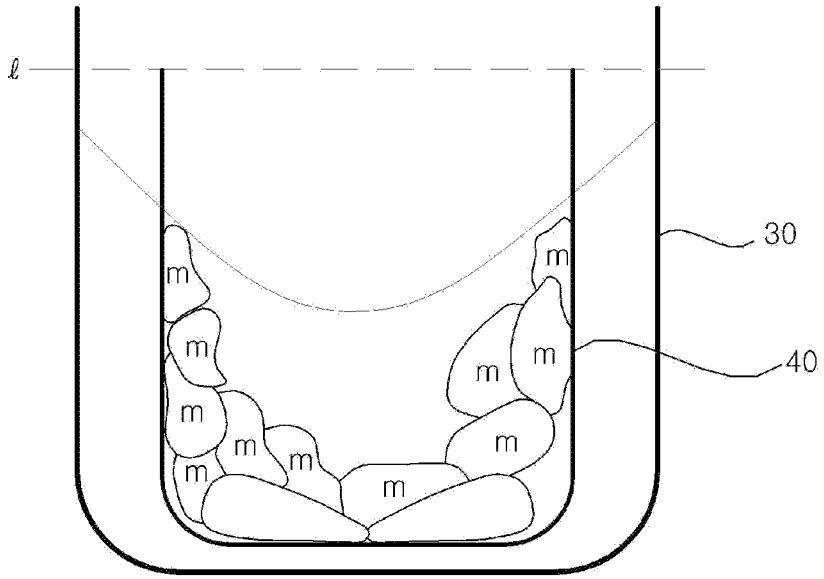
FIG. 18 illustrates the form of a pressurized water flow formed in the operation of a washing machine according to an embodiment of the present invention.
Figure 19:
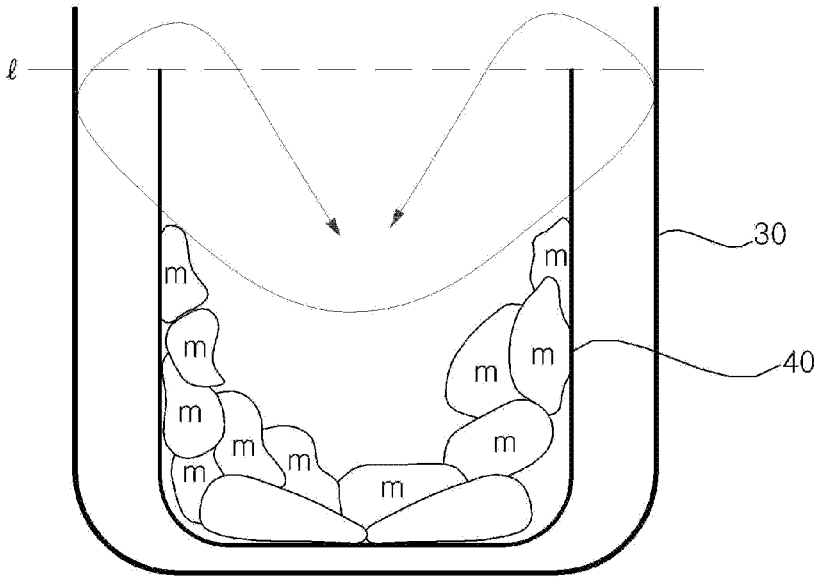
FIG. 19 illustrates the form of a centrifugal water circulation formed in the operation of a washing machine according to an embodiment of the present invention.

FIG. 17 illustrates the form of agitated water flow formed in the operation of a washing machine according to an embodiment of the present invention, FIG. 18 illustrates the form of a pressurized water flow formed in the operation of a washing machine according to an embodiment of the present invention, and FIG. 19 illustrates the form of a centrifugal water circulation formed in the operation of a washing machine according to an embodiment of the present invention. Hereinafter, respective water flows will be described with reference to FIGS. 17 to 19.

Referring to FIG. 17, the agitated water flow is formed by agitating rotation of the pulsator 45 which alternately rotates clockwise and counterclockwise. Therefore, a flow direction of the agitated water flow alternatively changes clockwise and counterclockwise. As a result, the washing water in the inner tub 40 is agitated by inertia generated as the direction of the water flow changes.

The agitated water flow may be formed in a process for disentangling the laundry m that is disentangled and loaded in the inner tub 40, a process for washing the laundry m using frictional action between the pulsator 45 and the laundry m, or a process for evenly mixing the detergent and the wash water that are supplied into the inner tub 40.

Referring to FIG. 18, the pressurized water flow is generated by the rotation of the inner tub 40. The laundry is adhered to an inner wall of the inner tub 40 by the centrifugal force generated as the inner tub 40 rotates and the wash water rises along a space defined between the outer and inner tubs 30 and 40. At this point, a height of the wash water rising along the space between the outer and inner tubs 30 and 40 does not exceed an upper end of the inner tub 40.

The height of the wash water rising along the space between the outer and inner tubs 30 and 40 will be determined in accordance with the RPM of the inner tub 40 and the amount of the wash water filled in the outer tub 30. The amount of the wash water filled in the outer tub 30 may vary according to an amount of the laundry. Referring to FIG. 19, centrifugal water circulation is generated by the rotation of the inner tub 40. The laundry m is adhered to the inner wall of the inner tub 40 by the centrifugal force generated as the inner tub 40 and the wash water rises along the space between the outer and inner tubs 30 and 40, is guided along the bottom surface of the outer tub cover 20, and is finally poured into the inner tub 40, thereby forming the centrifugal water circulation.

The height of the wash water rising along the space between the outer and inner tubs 30 and 40 is determined according to the RPM of the inner tub 40 and the amount of the wash water filled in the outer tub 30. The wash water supplied to the outer tub 30 may vary in accordance with the amount of the laundry. When comparing with the pressurized water flow, the RPM of the inner tub 40 should be higher than that for forming the pressurized water flow in order to form the centrifugal water circulation under the condition where the amount of the wash water filled in the outer tub 30 is same.

During the forming of the centrifugal water circulation, the wash water may be splattered out of the outer tub 30 depending on a flow speed and a flow intensity of the centrifugal water circulation at a time point where the wash water rises along the space between the outer and inner tubs 30 and 40 and is poured into the inner tub 40. In this case, the pressurized water flow may be formed by reducing the RPM of the inner tub 40. This shift process of the water flow will be determined in accordance with whether the wash water is splattered out of the outer tub 30 or not. This will be described with reference to a washing method according to an embodiment of the present invention.

Figure 20:
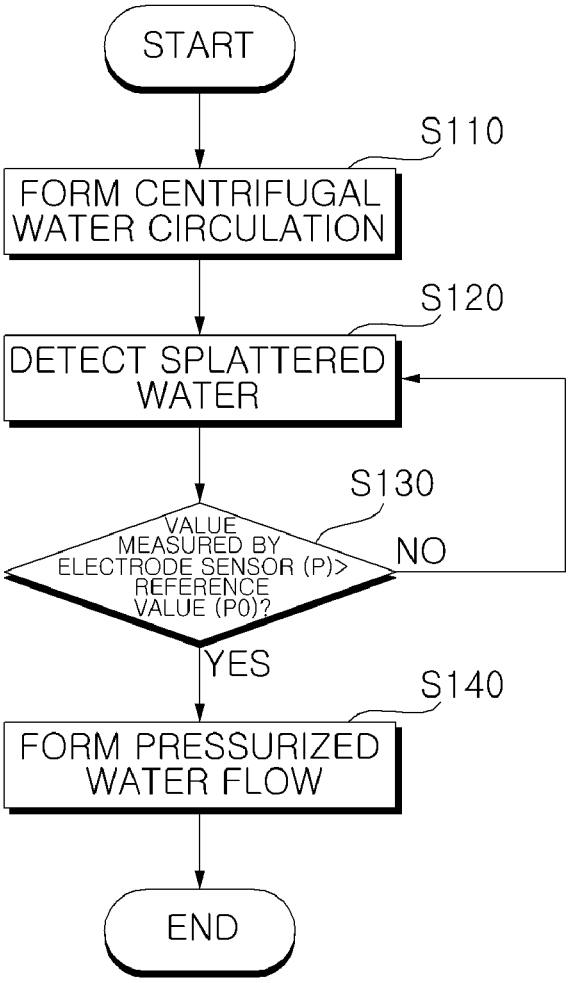
FIG. 20 is a flowchart illustrating a washing method according to an embodiment of the present invention.
Figure 21:
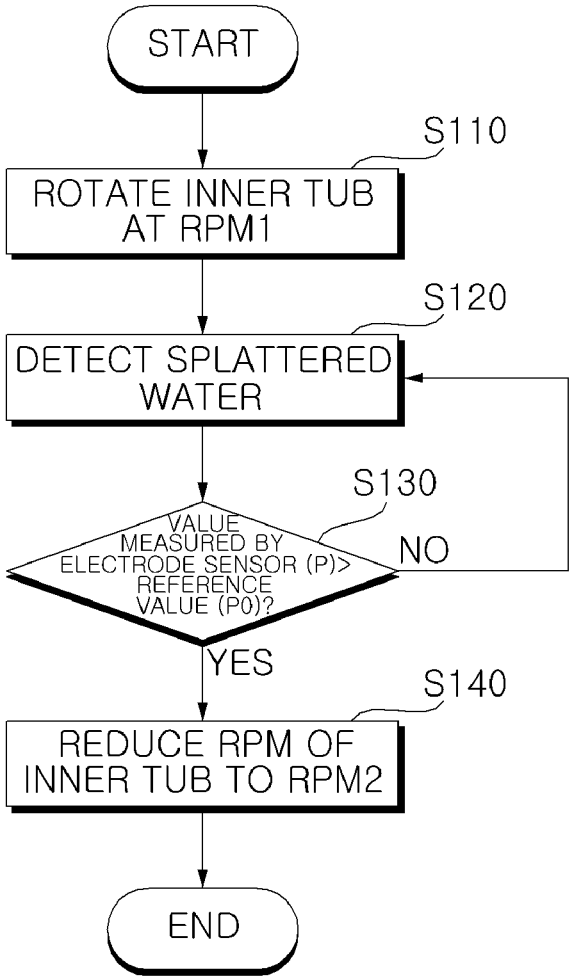
FIG. 21 is a flowchart illustrating the washing method in FIG. 20 in terms of motor rotation speed variation.

FIG. 20 is a flowchart illustrating a washing method according to an embodiment of the present invention and FIG. 21 is a flowchart illustrating the washing method of FIG. 20 in terms of motor rotation speed.

Referring to FIGS. 20 and 21, a washing method according to an embodiment of the present invention includes a process for forming the centrifugal water circulation at a predetermined step during the operation of the washing machine W (S110), a process for detecting the splattered water using the electrode sensor 70 (S120), a process for determining that the wash water is splattered out of the outer tub 30 as the electrodes 72*a* and 72*b* of the electrode sensor 70 are electrically interconnected by an amount of the wash water that is greater than a predetermined amount and collected in the water collecting portion 152 when a value P measured by the electrode sensor 70 is greater than a reference value Po (S130), and a process for shifting the current centrifugal water circulation into the pressurized water flow (S140).

In the process for forming the centrifugal water circulation (S110), the control unit 55 properly shifts the clutch 35 to enable only the inner tub 40 to rotate or the inner tub 40 and pulsator 45 to integrally rotate together. At this point, the motor 50 rotates at an RPM1 where the laundry is adhered to the inner wall of the inner tub 40 by the centrifugal force and integrally rotates together with the inner tub 40 and the wash water rises along the space between the outer and inner tubs 30 and 40 and is poured into the inner tub 40 by being guided by the bottom surface of the outer tub cover 20.

After the above, when it is determined that the splattered water is detected by the value detected in the process S120 for detecting the splattered water (S130), the control unit reduces the RPM of the motor 50. At this point, the RPM of the motor 50 is an RPM where the laundry is adhered to the inner wall of the inner tub 40 to rotate together with the inner tub 40 by the centrifugal force and the wash water rises along the space between the outer and inner tubs 30 and 40 only up to a height lower than the upper end of the inner tub 40.

According to the washing method of this embodiment, when the splatter of the wash water is detected in the course of which the centrifugal water circulation is formed, the RPM of the inner tub 40 is reduced to form the pressurized water flow, thereby preventing the wash water from being further splattered.

Figure 22:
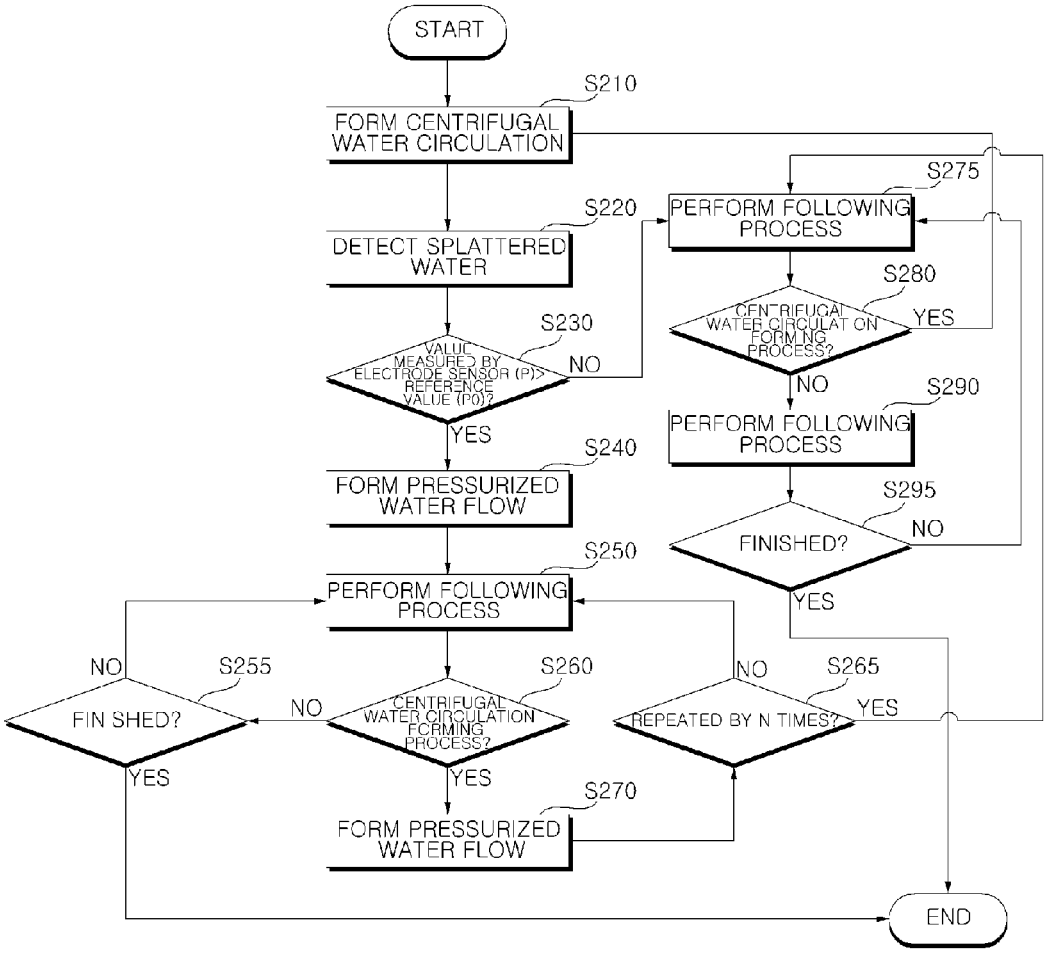
FIG. 22 is a flowchart illustrating a washing method according to another embodiment of the present invention.

FIG. 22 is a flowchart illustrating a washing method according to another embodiment of the present invention. Referring to FIG. 22, a centrifugal water circulation is formed in a predetermined step during the operation of the washing machine W (S210). Splattered water is detected by the electrode sensor 70 (S220). When a value P measured by the electrode sensor 70 is greater than a reference value Po, it is determined that a predetermined amount or more of the splattered water is collected in the water collecting portion 152 (S230), after which the current centrifugal water circulation is shifted into the pressurized water flow (S240). After this, while performing a following process according to a preset algorithm (S250), when a process reaches a process S260 for forming the centrifugal water circulation again during the operation of the washing machine W, the pressurized water flow instead of the centrifugal water circulation is formed (S270).

According to the washing method of this embodiment, when it is detected that the wash water is splattered to the base in the process S210 for forming the centrifugal water circulation, the pressurized water flow instead of the centrifugal water circulation is formed in the following process that is set to form the centrifugal water circulation, thereby preventing the wash water from being further splattered. At this point, the process for forming the pressurized water flow instead of the centrifugal water circulation after the splatter of the wash water is detected is repeated by the predetermined number N (S265), the centrifugal water circulation is not shifted to the pressurized water flow any more in the following process for forming the centrifugal water circulation but the centrifugal water circulation is normally formed in the following process.

As described above, according to the washing method of this embodiment, when it is detected in the forming of the centrifugal water circulation by the electrode sensor 70 that the wash water is splattered to the base 100, the further splatter of the wash water to the base 100 is prevented, and the pressurized water flow instead of the centrifugal water circulation is formed until the wash water stored in the base 100 is removed and until the N-th centrifugal water circulation forming process.

Meanwhile, in the process S220 for detecting the splattered water, when the value P measured by the electrode sensor 70 is less than the reference value Po, the centrifugal water circulation is continuously formed without reducing the RPM of the motor 50, after which the following process is performed according to the preset algorithm (S275). After then, when the process that is set to form the centrifugal water circulation reaches again, the centrifugal water circulation is originally formed (S280, S210), after which the process S220 for detecting the splattered water and the process S230 for comparing the value P measured by the electrode sensor with the reference value Po are performed again.

Figure 23:
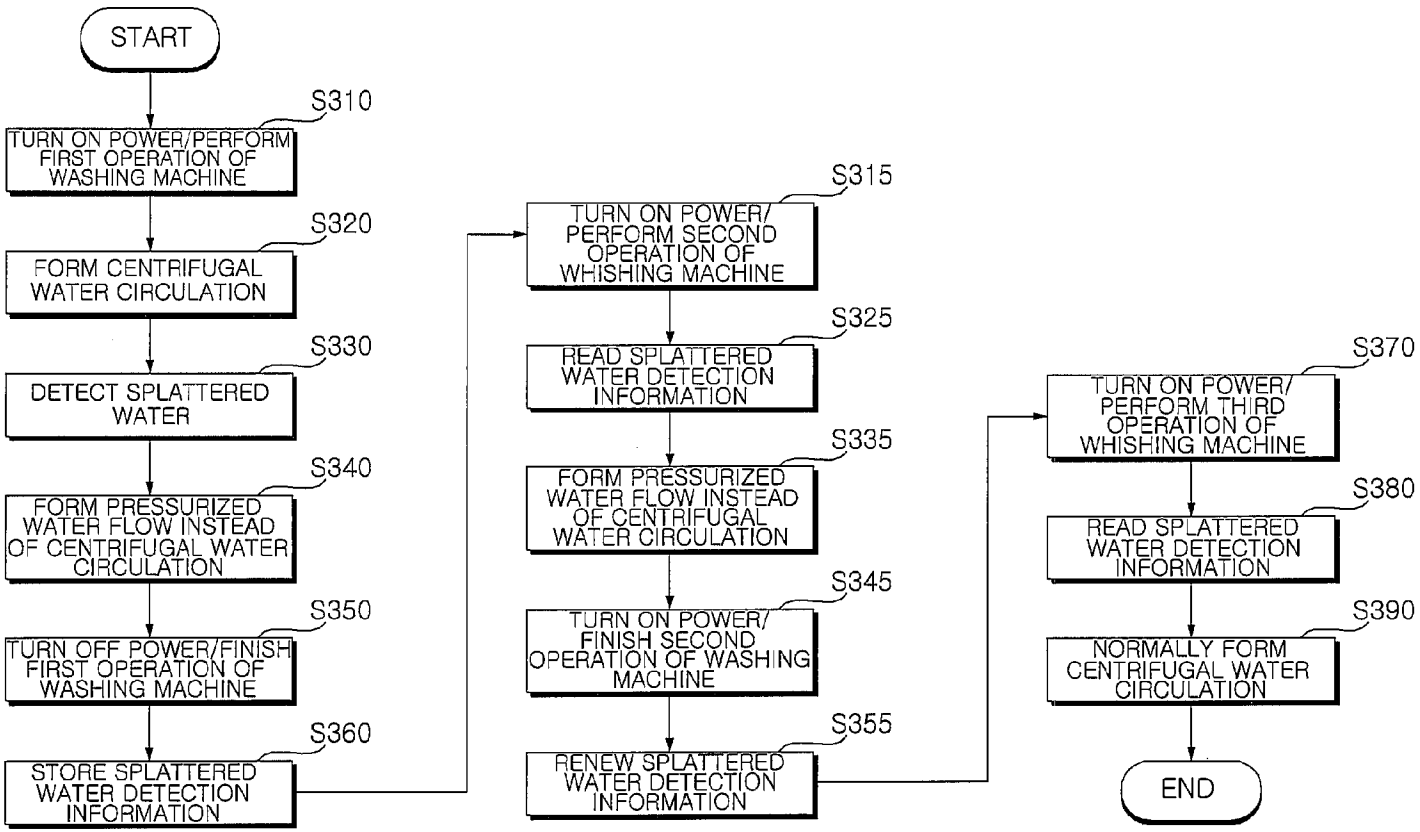
FIG. 23 is a flowchart illustrating a washing method according to a further embodiment of the present invention.

FIG. 23 is a flowchart illustrating a washing method according to a further embodiment of the present invention. Referring to FIG. 23, a washing machine of this embodiment splattered water detection information that is detected by the electrode sensor 70 during the operation of the washing machine W is stored not to be deleted even when electric power of the washing machine W is turned off. Therefore, when the washing machine W operate again by applying electric power, the control unit 55 reads the splattered water detection information that is stored and determines if it forms the pressurized water flow instead of the centrifugal water circulation in a process, which is set to form the centrifugal water circulation, in accordance with the splattered water detection information.

For example, when the splattered water is detected by the electrode sensor 70 during the operation of the washing machine, the control unit 55 forms the pressurized water flow instead of the centrifugal water circulation during restart of the washing machine whose electric power is turned off.

After a process for turning on and off the electric power of the washing machine W is repeated by the predetermined number N, when the washing machine operates again, the centrifugal water circulation is normally formed in the process that is set to form the centrifugal water circulation. That is, when the splattered water is detected by at least one time during the operation of the washing machine W, the pressurized water flow instead of the centrifugal water circulation is formed until the N-th washing machine operation is performed, thereby preventing the wash water from being further splattered and attaining a time for which the wash water collected in the base 100 is vaporized (removed).

This will be described in more detail with reference to FIG. 23, In the following description, it is assumed that the predetermined number N is 1 (i.e., N=1).

Electric power is applied to the washing machine W and the washing machine performs first operation (S310). When the process S320 for forming the centrifugal water circulation is performed during the first operation of the washing machine, it is detected by the electrode sensor if the wash water is splattered to the base 100 (S330). When the splattered water is detected in the process S330, the pressurized water flow instead of the centrifugal water circulation is formed in a following process that is set to form the centrifugal water circulation (S340). The washing machine W is turned off and the first operation of the washing machine W is finished (S350). At this point, the splattered water detection information detected by the electrode sensor 70 in the process S330 for detecting the splattered water is stored in a memory 53.

After the above, when the user turns on the electric power of the washing machine again and the washing machine performs second operation (S315), the control unit 55 reads the splattered water detection information stored in the memory 53 (S325). When the information shows that the splattered water is detected, the pressurized water flow instead of the centrifugal water circulation is formed in a following process that is set to form the centrifugal water circulation (S335). The washing machine W is turned off and a second operation of the washing machine W is finished (S345). At this point, the splattered water detection information stored in the memory 53 is renewed to include the number of reoperations of the washing machine, which is performed after the first operation of the washing machine is finished (S355).

After the above, the electric power of the washing machine W is turned on again and the washing machine performs third operation (S370), after which the control unit 55 determines in accordance with the information read from the memory 53 if it forms the centrifugal water circulation or the pressurized water flow in the following process that is set to form the centrifugal water circulation (S380).

At this point, since the information stored in the memory 53 includes the number of reoperations of the washing machine, which is performed after the first operation of the washing machine is finished, and it is assumed in this embodiment that the predetermined number N is 1, the pressurized water flow instead of the centrifugal water circulation is not formed any more in the process that is set to form the centrifugal water circulation during the third operation of the washing machine but the centrifugal water circulation is normally formed (S390) (satisfaction of the condition (N=1).

According to the washing method of this embodiment, when the splattered water is detected during the operation of the washing machine W, the pressurized water flow instead of the centrifugal water circulation is formed until the number of reoperation of the washing machine reaches N, thereby preventing the wash water from being further splattered.

According to the washing machine of the present invention, the splattered wash water can be accurately detected by disposing the electrode sensor at a left or right side of a rear portion of the base to which a large amount of the wash water is splattered.

In addition, since the location at which the electrode sensor will be disposed is set considering a splatter direction in which a large amount of the wash water is splattered in accordance with a rotational direction of the inner tub when the centrifugal water circulation is formed, the splatter of the wash water can be accurately detected.

Further, the wash water that is splattered during the rotation of the inner tub and is drained to the base through the splattered water drain hole formed on the outer tub cover can be accurately detected.

In addition, even when the outer tub is deformed by dynamic action caused by the vibration and centrifugal force that are generated during the rotation of the inner tub, and thus the wash water is biased to a specific direction and is splattered, this can be accurately detected.

Furthermore, since the wash water that is splattered during the rotation of the inner tub is stored in the base provided on the lower portion of the cabinet, the leakage of the splattered wash water out of the washing machine can be prevented.

Furthermore, since the wash water splattered to the base is collected near the electrode sensor, the splatter of the wash water can be more accurately detected.

In addition, by improving the structure of the air hole of the back panel provided at the rear portion of the cabinet, the leakage of the washing water, which is splattered during the rotation of the inner tub, through the air hole can be prevented.

According to the washing method of the present invention, as the splatter of the wash water out of the outer tub during the forming of the centrifugal water circulation is detected and the pressurized water flow is formed by reducing the RPM of the inner tub, the further splatter of the wash water can be prevented.

In addition, when the splatter of the wash water out of the outer tub is detected in the process for forming the centrifugal water circulation during the operation of the washing machine, the pressurized water flow instead of the centrifugal water circulation is formed in a N-th centrifugal water circulation forming process that is set to be performed later, thereby preventing the wash water from being further splattered.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A washing machine comprising:

a cabinet;

an outer tub disposed in the cabinet and provided with an opened top through which wash water supplied into the outer tub;

an inner tub that is disposed in the outer tub to receive laundry and rotates about a vertical axis;

an electrode sensor comprising first and second electrodes; and a base that supports the cabinet, the base comprising a downwardly inclined surface, said inclined surface terminating downwardly in a vertical wall;

a level surface raised with respect to a bottom of the base having a groove in which the wash water splattered out of the outer tub and flowing down along the inclined surface is collected;

a bracket for fixing the electrode sensor provided on the level surface, the bracket being on the outside of the groove; and a first rib protruding from the level surface, wherein a perimeter of the level surface is partially bounded by the first rib and the vertical wall, wherein the first and second electrodes are mounted to the bracket and arranged inside the groove, and wherein a gap for discharging an overflow of the wash water from the groove to outside the level surface is formed between an end of the first rib and the electrode sensor.

2. The washing machine of claim 1, further comprising a control unit that, when the wash water splattered to the base is detected by the electrode sensor during the forming of centrifugal water circulation formed by the wash water that rises along a space defined between the outer and inner tubs by continuous rotation of the inner tub in a direction and is poured into the inner tub, reduces an RPM of the inner tub such that a rising height of the wash water rising along the space between the inner and outer tubs is lower than an upper end of the inner tub.

3. The washing machine of claim 1, wherein the base further comprises a second rib protruding from the inclined surface, the second rib extending along an inclined direction to limit flow of the wash water flowing along the inclined surface in a lateral direction.

4. The washing machine of claim 1, wherein the first and second electrodes are spaced apart from each other, and wherein the first and second electrodes are spaced apart from a bottom surface of the groove.

5. The washing machine of claim 4, wherein the first and second electrodes are disposed in parallel with the bottom surface of the groove.

6. The washing machine of claim 4, wherein the first and second electrodes are disposed to be vertical to the bottom surface of the groove.

7. The washing machine of claim 1, wherein the base further comprises a first water storage unit that is formed along a circumference of the base to collect the splattered water flowing down along an inner surface of the cabinet, wherein the first water storage unit has an elevated surface which guides wash water splattered thereon downwards, wherein a cylindrical coupling portion protrudes from the elevated surface, and wherein a coupling member for fixing the cabinet is coupled to the cylindrical coupling portion by being inserted into the cylindrical coupling portion along a longitudinal direction of the cylindrical coupling portion.

8. The washing machine of claim 1, further comprising a back panel coupled to a rear portion of the cabinet and provided with an air hole communicating with an inside of the cabinet, wherein the back panel comprises a splattered water guide that extends from an upper portion of the air hole toward the inside of the cabinet and is inclined downward toward the inside of the cabinet to prevent the splattered water from leaking to an external side through the air hole.

9. The washing machine of claim 8, wherein the splattered water guide is formed by bending a part that is partly cut from the back panel toward the inside of the cabinet to form the air hole.

10. The washing machine of claim 1, wherein the base has a central opening and a third rib is formed along a circumference of the central opening.

11. The washing machine of claim 1, wherein the electrode sensor is disposed at a left side of a rear portion of the base.

12. The washing machine of claim 1, wherein the electrode sensor is disposed at a right side of a rear portion of the base and the inner tub rotates clockwise when the centrifugal water circulation that is formed by the wash water that rises along a space defined between the outer and inner tubs by continuous rotation of the inner tub in a direction and is poured into the inner tub is formed.

* * * * *